US008624492B2

(12) United States Patent
Lee et al.

(10) Patent No.: US 8,624,492 B2
(45) Date of Patent: Jan. 7, 2014

(54) PLASMA DISPLAY PANEL AND MULTI-PLASMA DISPLAY PANEL

(75) Inventors: Soomyun Lee, Gumi (KR); Kyungtae Kim, Gumi (KR)

(73) Assignee: LG Electronics Inc., Seoul (KR)

( * ) Notice: Subject to any disclaimer, the term of this patent is extended or adjusted under 35 U.S.C. 154(b) by 187 days.

(21) Appl. No.: 13/094,031

(22) Filed: Apr. 26, 2011

(65) Prior Publication Data

US 2011/0259624 A1 Oct. 27, 2011

(30) Foreign Application Priority Data

Apr. 26, 2010 (KR) ..... 10-2010-0038459

(51) Int. Cl.
*H01J 17/49* (2012.01)

(52) U.S. Cl.
USPC ..... 313/582; 313/583; 313/585; 313/586

(58) Field of Classification Search
USPC ..... 313/582–587
See application file for complete search history.

(56) References Cited

U.S. PATENT DOCUMENTS 5,734,228 A * 3/1998 Kwon et al. ..... 313/582
5,969,478 A * 10/1999 Shino et al. ..... 315/169.4
6,242,859 B1 * 6/2001 Betsui et al. ..... 313/584
6,538,380 B1 * 3/2003 Kanagu et al. ..... 313/582
7,758,396 B2 * 7/2010 Okawa et al. ..... 445/24
2006/0132037 A1 * 6/2006 Okawa et al. ..... 313/582
2006/0250087 A1 * 11/2006 Kikuchi ..... 313/582
2007/0046205 A1 * 3/2007 Kwon et al. ..... 313/582
2010/0237776 A1 * 9/2010 Kim et al. ..... 313/582

FOREIGN PATENT DOCUMENTS

JP 2002-367526 A 12/2002
JP 2006-019168 A1 1/2006
WO WO 2004/051691 A1 6/2004
WO WO 2009/031181 A1 3/2009

OTHER PUBLICATIONS

European Search Report dated Oct. 25, 2011 issued in Application No. 11 00 2304.

* cited by examiner

*Primary Examiner* — Anne Hines
*Assistant Examiner* — Jose M Diaz
(74) *Attorney, Agent, or Firm* — KED & Associates, LLP

(57) ABSTRACT

A plasma display panel and a multi plasma display panel are disclosed. The plasma display panel includes a front substrate, a back substrate positioned opposite the front substrate, a barrier rib positioned between the front substrate and the back substrate to partition a discharge cell, and a seal portion positioned outside the barrier rib in an area between the front substrate and the back substrate. A distance between the barrier rib and the seal portion on one side of the plasma display panel is different from a distance between the barrier rib and the seal portion on the other side of the plasma display panel opposite the one side.

8 Claims, 18 Drawing Sheets

PLASMA DISPLAY PANEL AND MULTI-PLASMA DISPLAY PANEL

This application claims the benefit of Korean Patent Application No. 10-2010-0038459 filed on Apr. 26, 2010, which is incorporated herein by reference for all purposes as if fully set forth herein.

BACKGROUND OF THE INVENTION

1. Field of the Invention

Embodiments of the invention relate to a plasma display panel and a multi plasma display panel.

2. Description of the Related Art

A plasma display panel includes a phosphor layer inside discharge cells partitioned by barrier ribs and a plurality of electrodes.

When driving signals are applied to the electrodes of the plasma display panel, a discharge occurs inside the discharge cells. More specifically, when the discharge occurs in the discharge cells by applying the driving signals to the electrodes, a discharge gas filled in the discharge cells generates vacuum ultraviolet rays, which thereby cause phosphors between the barrier ribs to emit visible light. An image is displayed on the screen of the plasma display panel using the visible light.

SUMMARY OF THE INVENTION

In one aspect, there is a plasma display panel comprising a front substrate, a back substrate positioned opposite the front substrate, a barrier rib positioned between the front substrate and the back substrate to partition a discharge cell, and a seal portion positioned outside the barrier rib in an area between the front substrate and the back substrate, wherein a distance between the barrier rib and the seal portion on one side of the plasma display panel is different from a distance between the barrier rib and the seal portion on the other side of the plasma display panel opposite the one side.

In another aspect there is a plasma display panel comprising a front substrate, a back substrate positioned opposite the front substrate, a barrier rib positioned between the front substrate and the back substrate to partition a discharge cell, and a seal portion positioned outside the barrier rib in an area between the front substrate and the back substrate, wherein a distance between the barrier rib and the seal portion in a first region of each of the front substrate and the back substrate is different from a distance between the barrier rib and the seal portion in a second region of each of the front substrate and the back substrate opposite the first region, wherein a distance between the barrier rib and the seal portion in a third region of each of the front substrate and the back substrate adjacent to the first and second regions is different from a distance between the barrier rib and the seal portion in a fourth region of each of the front substrate and the back substrate opposite the third region.

In yet another aspect, there is a multi plasma display panel comprising a first plasma display panel and a second plasma display panel disposed adjacent to the first plasma display panel, wherein each of the first and second plasma display panels includes a front substrate, a back substrate positioned opposite the front substrate, a barrier rib positioned between the front substrate and the back substrate to partition a discharge cell, and a seal portion positioned outside the barrier rib in an area between the front substrate and the back substrate, wherein a distance between the barrier rib and the seal portion on one side of each of the first and second plasma display panels is greater than a distance between the barrier rib and the seal portion on the other side of each of the first and second plasma display panels opposite the one side.

In still another aspect, there is a multi plasma display panel comprising a first plasma display panel, a second plasma display panel disposed adjacent to the first plasma display panel in a first direction, a third plasma display panel disposed adjacent to the first plasma display panel in a second direction crossing the first direction, and a fourth plasma display panel that is disposed adjacent to the third plasma display panel in the first direction and is disposed adjacent to the second plasma display panel in the second direction, wherein each of the first, second, third, and fourth plasma display panels includes a front substrate, a back substrate positioned opposite the front substrate, a barrier rib positioned between the front substrate and the back substrate to partition a discharge cell, and a seal portion positioned outside the barrier rib in an area between the front substrate and the back substrate, wherein a distance between the barrier rib and the seal portion in a first region of each of the front substrate and the back substrate of each of the first to fourth plasma display panels is different from a distance between the barrier rib and the seal portion in a second region of each of the front substrate and the back substrate of each of the first to fourth plasma display panels opposite the first region, wherein a distance between the barrier rib and the seal portion in a third region of each of the front substrate and the back substrate of each of the first to fourth plasma display panels adjacent to the first and second regions is different from a distance between the barrier rib and the seal portion in a fourth region of each of the front substrate and the back substrate of each of the first to fourth plasma display panels opposite the third region.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail embodiments of the invention examples of which are illustrated in the accompanying drawings.

According to various embodiments of the invention, any one or more features from one embodiment/example/variation of the invention can be applied to (e.g., added, substituted, modified, etc.) any one or more other embodiments/examples/variations discussed below according to the invention. Further any operations/methods discussed below can be implemented in any of these devices/units or other suitable devices/units.

Figure 1:
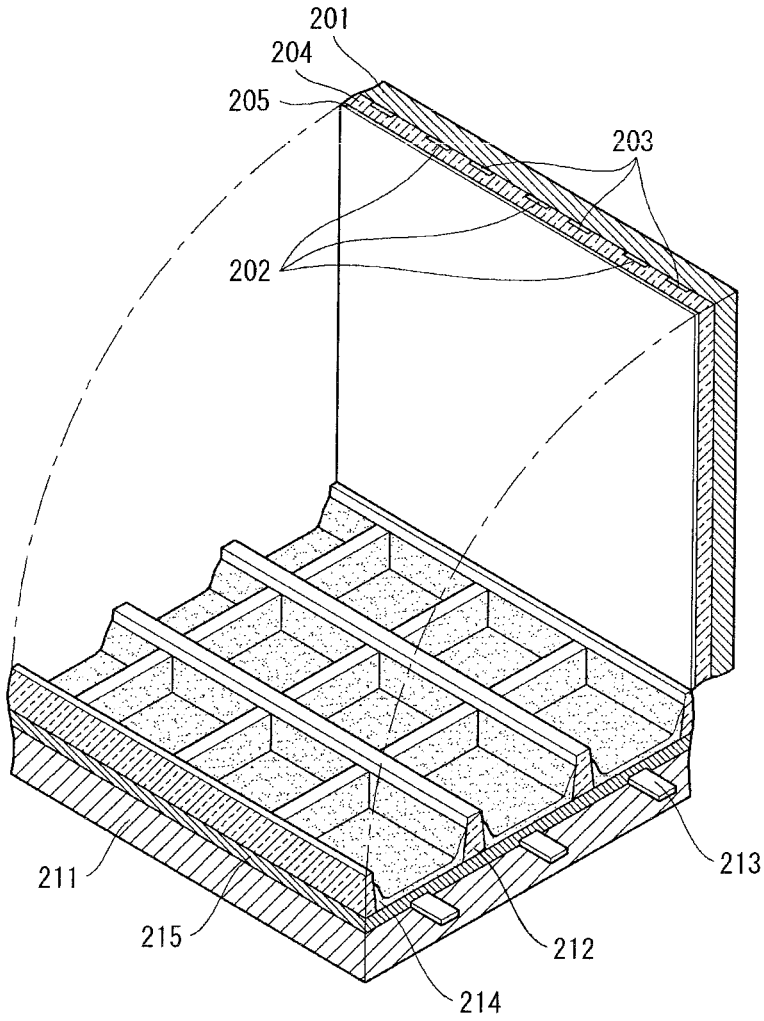
FIGS. 1 to 3 illustrate a structure and a driving method of a plasma display panel according to an exemplary embodiment of the invention.
Figure 2:
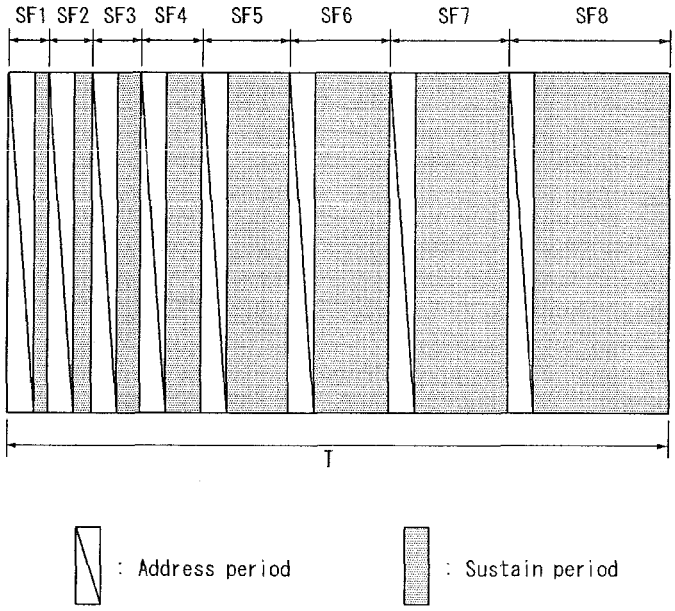
Figure 3:
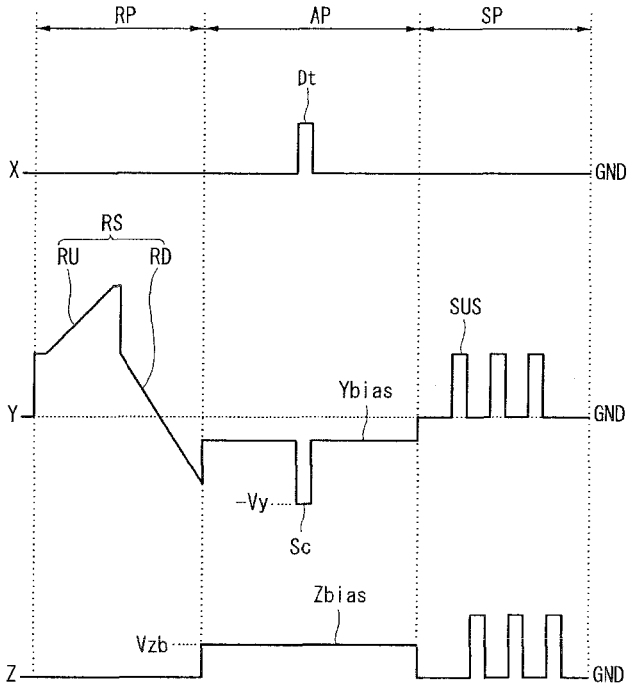

FIGS. 1 to 3 illustrate a structure and a driving method of a plasma display panel according to an exemplary embodiment of the invention.

A plasma display panel may display an image in a frame including a plurality of subfields.

More specifically, as shown in FIG. 1, the plasma display panel may include a front substrate 201, on which a plurality of first electrodes 202 and 203 are formed, and a back substrate 211 on which a plurality of second electrodes 213 are formed to cross the first electrodes 202 and 203.

In FIGS. 1 to 3, the first electrodes 202 and 203 may include scan electrodes 202 and sustain electrodes 203 substantially parallel to each other, and the second electrodes 213 may be called address electrodes.

An upper dielectric layer 204 may be formed on the scan electrode 202 and the sustain electrode 203 to limit a discharge current of the scan electrode 202 and the sustain electrode 203 and to provide insulation between the scan electrode 202 and the sustain electrode 203.

A protective layer 205 may be formed on the upper dielectric layer 204 to facilitate discharge conditions. The protective layer 205 may be formed of a material having a high secondary electron emission coefficient, for example, magnesium oxide (MgO).

A lower dielectric layer 215 may be formed on the address electrode 213 to provide insulation between the address electrodes 213.

Barrier ribs 212 of a stripe type, a well type, a delta type, a honeycomb type, etc. may be formed on the lower dielectric layer 215 to provide discharge spaces (i.e., discharge cells). Hence, a first discharge cell emitting red light, a second discharge cell emitting blue light, and a third discharge cell emitting green light, etc. may be formed between the front substrate 201 and the back substrate 211.

The address electrode 213 may cross the scan electrode 202 and the sustain electrode 203 in one discharge cell. Namely, each discharge cell is formed at a crossing of the scan electrode 202, the sustain electrode 203, and the address electrode 213.

Each of the discharge cells provided by the barrier ribs 212 may be filled with a predetermined discharge gas.

A phosphor layer 214 may be formed inside the discharge cells to emit visible light for an image display during an address discharge. For example, first, second, and third phosphor layers that respectively generate red, blue, and green light may be &tined inside the discharge cells.

While the address electrode 213 may have a substantially constant width or thickness, a width or thickness of the address electrode 213 inside the discharge cell may be different from a width or thickness of the address electrode 213 outside the discharge cell. For example, a width or thickness of the address electrode 213 inside the discharge cell may be greater than a width or thickness of the address electrode 213 outside the discharge cell.

When a predetermined signal is supplied to at least one of the scan electrode 202, the sustain electrode 203, and the address electrode 213, a discharge may occur inside the discharge cell. The discharge may allow the discharge gas filled in the discharge cell to generate ultraviolet rays. The ultraviolet rays may be incident on phosphor particles of the phosphor layer 214, and then the phosphor particles may emit visible light. Hence, an image may be displayed on the screen of the plasma display panel 100.

A frame for achieving a gray scale of an image displayed on the plasma display panel is described with reference to FIG. 2.

As shown in FIG. 2, a frame for achieving a gray scale of an image may include a plurality of subfields. Each of the plurality of subfields may be divided into an address period and a sustain period. During the address period, the discharge cells not to generate a discharge may be selected or the discharge cells to generate a discharge may be selected. During the sustain period, a gray scale may be achieved depending on the number of discharges.

For example, if an image with 256-gray level is to be displayed, as shown in FIG. 2, a frame may be divided into 8 subfields SF1 to SF8. Each of the 8 subfields SF1 to SF8 may include an address period and a sustain period.

Furthermore, at least one of a plurality of subfields of a frame may further include a reset period for initialization. At least one of a plurality of subfields of a frame may not include a sustain period.

The number of sustain signals supplied during the sustain period may determine a gray level of each of the subfields. For example, in such a method of setting a gray level of a first subfield at $2^0$ and a gray level of a second subfield at $2^1$, the sustain period increases in a ratio of $2^n$ (where, n=0, 1, 2, 3, 4, 5, 6, 7) in each of the subfields. Hence, various gray levels of an image may be achieved by controlling the number of sustain signals supplied during the sustain period of each subfield depending on a gray level of each subfield.

Although FIG. 2 shows that one frame includes 8 subfields, the number of subfields constituting a frame may vary. For example, a frame may include 10 or 12 subfields. Further, although FIG. 2 shows that the subfields of the frame are arranged in increasing order of gray level weight, the subfields may be arranged in decreasing order of gray level weight or may be arranged regardless of gray level weight.

A driving waveform for driving the plasma display panel is illustrated in FIG. 3.

As shown in FIG. 3, a reset signal RS may be supplied to the scan electrode Y during a reset period RP for initialization of at least one of a plurality of subfields of a frame. The reset signal RS may include a ramp-up signal RU with a gradually rising voltage and a ramp-down signal RD with a gradually falling voltage.

More specifically, the ramp-up signal RU may be supplied to the scan electrode Y during a setup period of the reset period RP, and the ramp-down signal RD may be supplied to the scan electrode Y during a set-down period following the setup period SU. The ramp-up signal RU may generate a weak dark discharge (i.e., a setup discharge) inside the discharge cells. Hence, the wall charges may be uniformly distributed inside the discharge cells. The ramp-down signal RD subsequent to the ramp-up signal RU may generate a weak erase discharge (i.e., a set-down discharge) inside the discharge cells. Hence, the remaining wall charges may be uniformly distributed inside the discharge cells to the extent that an address discharge occurs stably.

During an address period AP following the reset period RP, a scan reference signal Ybias having a voltage greater than a minimum voltage of the ramp-down signal RD may be supplied to the scan electrode Y. In addition, a scan signal Sc falling from a voltage of the scan reference signal Ybias may be supplied to the scan electrode Y.

A pulse width of a scan signal supplied to the scan electrode during an address period of at least one subfield of a frame may be different from pulse widths of scan signals supplied during address periods of the other subfields of the frame. A pulse width of a scan signal in a subfield may be greater than a pulse width of a scan signal in a next subfield.

For example, a pulse width of the scan signal may be gradually reduced in the order of 2.6 μs, 2.3 μs, 2.1 μs, 1.9 μs, etc. or may be reduced in the order of 2.6 μs, 2.3 μs, 2.3 μs, 2.1 μs, . . . , 1.9 μs, 1.9 μs, etc. in the successively arranged subfields.

As above, when the scan signal Sc is supplied to the scan electrode Y, a data signal Dt corresponding to the scan signal Sc may be supplied to the address electrode X. As a voltage difference between the scan signal Sc and the data signal Dt is added to a wall voltage obtained by the wall charges produced during the reset period RP, an address discharge may occur inside the discharge cell to which the data signal Dt is supplied. In addition, during the address period AP, a sustain reference signal Zbias may be supplied to the sustain electrode Z, so that the address discharge efficiently occurs between the scan electrode Y and the address electrode X.

During a sustain period SP following the address period AP, a sustain signal SUS may be supplied to at least one of the scan electrode Y or the sustain electrode Z. For example, the sustain signal SUS may be alternately supplied to the scan electrode Y and the sustain electrode Z. Further, the address electrode X may be electrically floated during the sustain period SP. As the wall voltage inside the discharge cell selected by performing the address discharge is added to a sustain voltage Vs of the sustain signal SUS, every time the sustain signal SUS is supplied, a sustain discharge, i.e., a display discharge may occur between the scan electrode Y and the sustain electrode Z.

Figure 4:
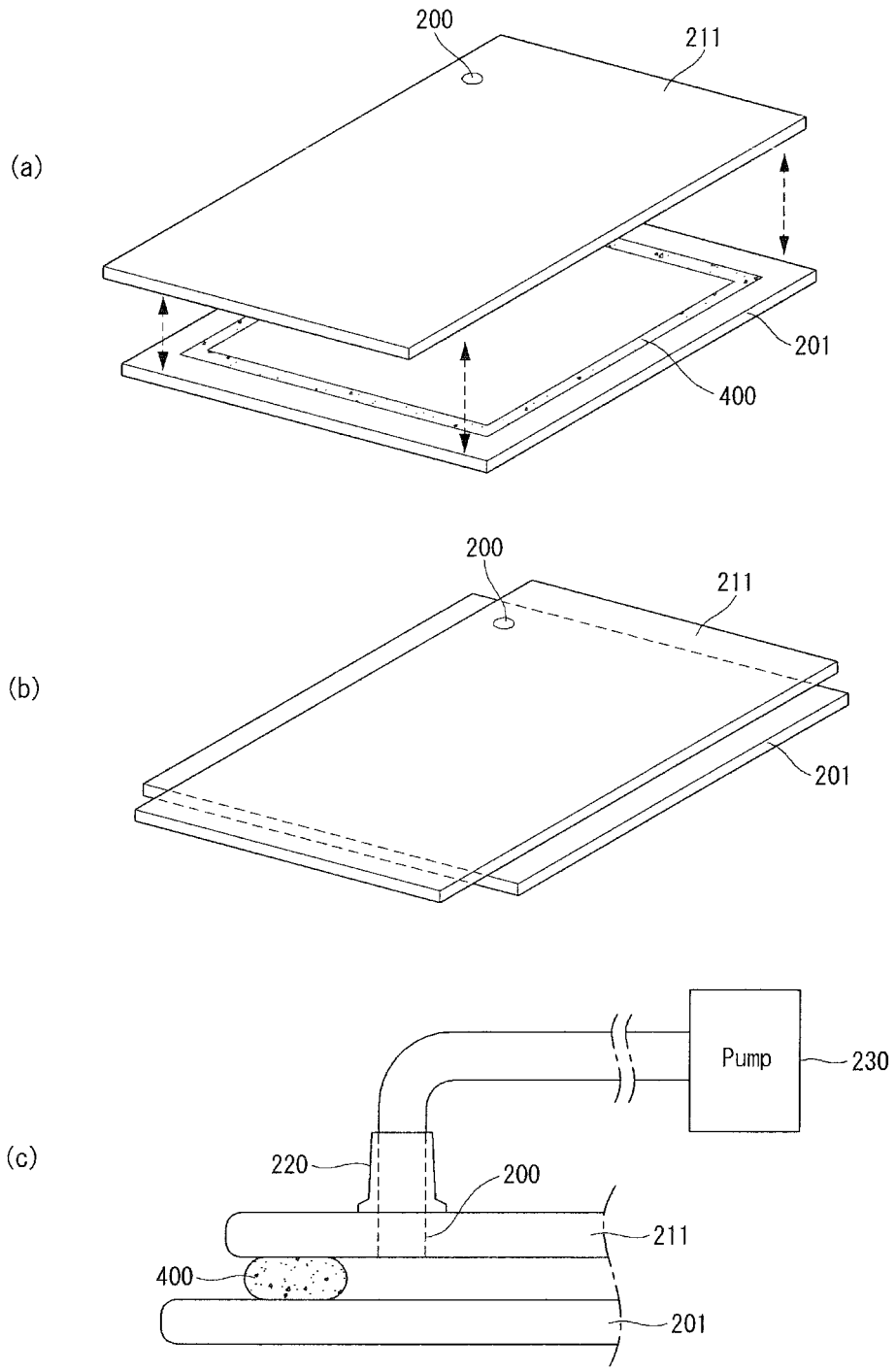
FIG. 4 illustrates a method for manufacturing a plasma display panel according to an exemplary embodiment of the invention.

FIG. 4 illustrates a method for manufacturing the plasma display panel according to the exemplary embodiment of the invention.

As shown in FIG. 4(*a*), a seal portion 400 may be formed outside the barrier rib 212 in an area between the front substrate 201 and the back substrate 211. In other words, the seal portion 400 may be formed at an edge of at least one of the front substrate 201 and the back substrate 211 on which an exhaust hole 200 is formed. Thus, as shown in FIG. 4(*b*), the front substrate 201 and the back substrate 211 may be attached to each other through the seal portion 400.

Subsequently, as shown in FIG. 4(*c*), an exhaust tip 220 may be connected to the exhaust hole 200, and an exhaust pump 230 may be connected to the exhaust tip 220. The exhaust pump 230 may exhaust an impurity gas remaining in a discharge space between the front substrate 201 and the back substrate 211 to the outside and may inject a discharge gas such as argon (Ar), neon (Ne), and xenon (Xe) into the discharge space. The discharge space between the front substrate 201 and the back substrate 211 may be sealed through the above-described method.

FIGS. 5 to 10 illustrate an exemplary configuration of the plasma display panel according to the exemplary embodiment of the invention.

Figure 5:
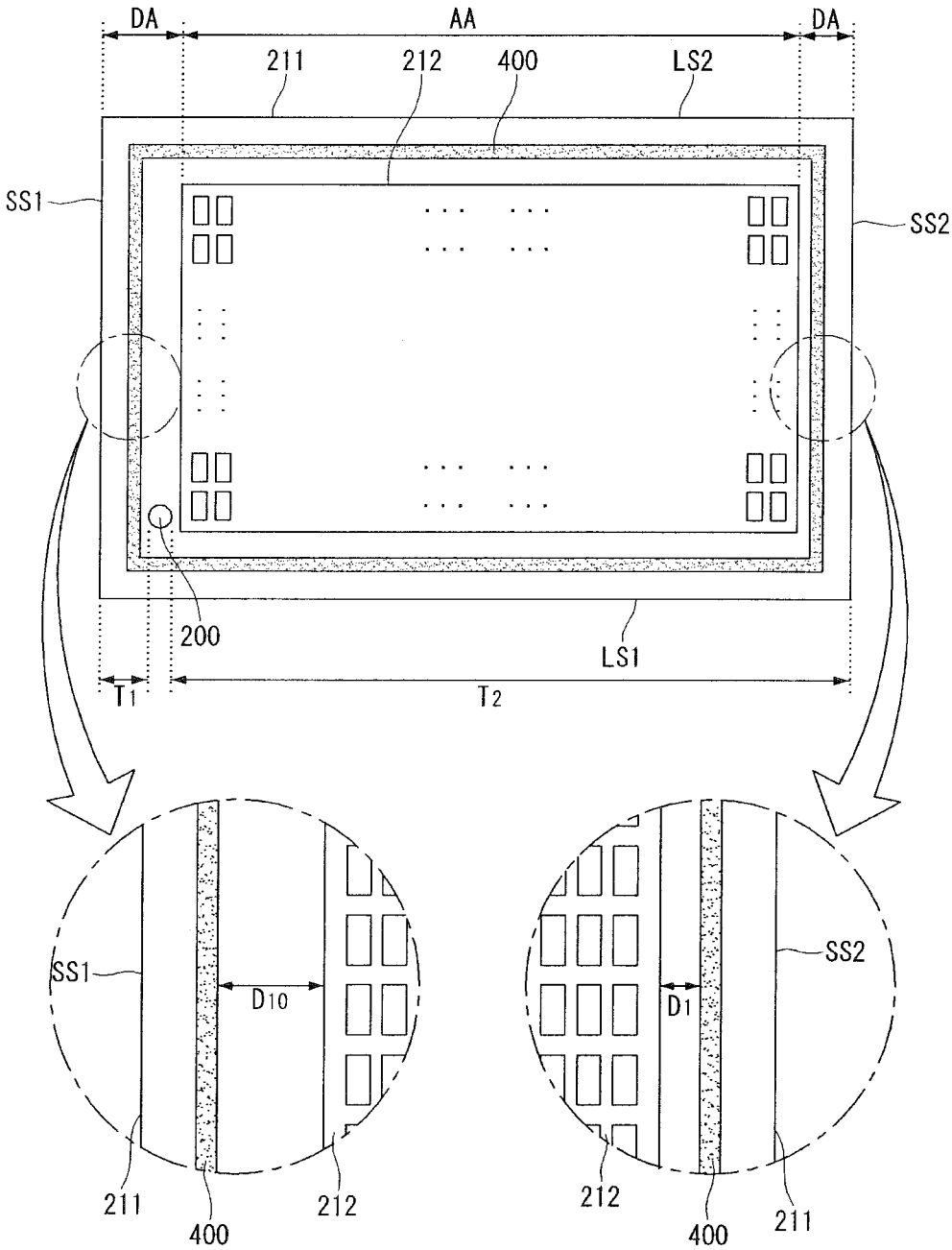
FIGS. 5 to 10 illustrate an exemplary configuration of a plasma display panel according to an exemplary embodiment of the invention.

As shown in FIG. 5, a distance between the seal portion 400 and the barrier rib 212 may vary depending on a component location of the plasma display panel.

Preferably, a distance between the seal portion 400 and the barrier rib 212 at one side of the plasma display panel may be different from a distance between the seal portion 400 and the barrier rib 212 at the opposite side of the plasma display panel. For example, a distance between the seal portion 400 and the barrier rib 212 at one side of the back substrate 211 may be different from a distance between the seal portion 400 and the barrier rib 212 at the opposite side of the back substrate 211. Alternatively, it may seem that a distance between the seal portion 400 and the barrier rib 212 at one side of the front substrate 201 is different from a distance between the seal portion 400 and the barrier rib 212 at the opposite side of the front substrate 201. In other words, the one side of the plasma display panel may correspond to one side of at least one of the front substrate 201 and the back substrate 211, and the opposite side of the plasma display panel may correspond to the opposite side of at least one of the front substrate 201 and the back substrate 211. Hereinafter, the distance is described based on the back substrate 211 for the sake of brevity.

As shown in FIG. 5, a distance D10 between the barrier rib 212 and the seal portion 400 in a third region of the back substrate 211 may be greater than a distance D1 between the barrier rib 212 and the seal portion 400 in a fourth region of the back substrate 211 opposite the third region. More specifically, the distance D10 between the barrier rib 212 and the seal portion 400 on a first short side SS1 of the back substrate 211 may be greater than the distance D1 between the barrier rib 212 and the seal portion 400 on a second short side SS2 of the back substrate 211. In the embodiment of the invention, the third region of the back substrate 211 may correspond to the first short side SS1 of the back substrate 211 having a rectangular shape, and the fourth region of the back substrate 211 may correspond to the second short side SS2 of the rectangular back substrate 211.

The exhaust hole 200 may be formed in the first short side SS1 of the back substrate 211. Thus, a distance T1 between the exhaust hole 200 and the first short side SS1 may be less than a distance T2 between the exhaust hole 200 and the second short side SS2.

Further, it may be preferable that the exhaust hole 200 is formed between the seal portion 400 and the barrier rib 212 on the first short side SS1 of the back substrate 211. In other words, the exhaust hole 200 may be formed in a dummy area DA of the first short side SS1 of the back substrate 211.

As above, when the barrier rib 212 is positioned closer to the second short side SS2 than the first short side SS1 of the back substrate 211, the first short side SS1 of the back substrate 211 may provide a sufficient space. Hence, the exhaust hole 200 may be formed on the first short side SS1 of the back substrate 211. In this instance, because the sufficient space for the exhaust hole 200 may be provided on the first short side SS1 of the back substrate 211, the size of the exhaust hole 200 may increase. Hence, the exhaust characteristics may be improved without increasing the size of the plasma display panel. As a result, an excessive increase in the size of a bezel area of the plasma display panel may be prevented while improving the exhaust characteristics.

Figure 6:
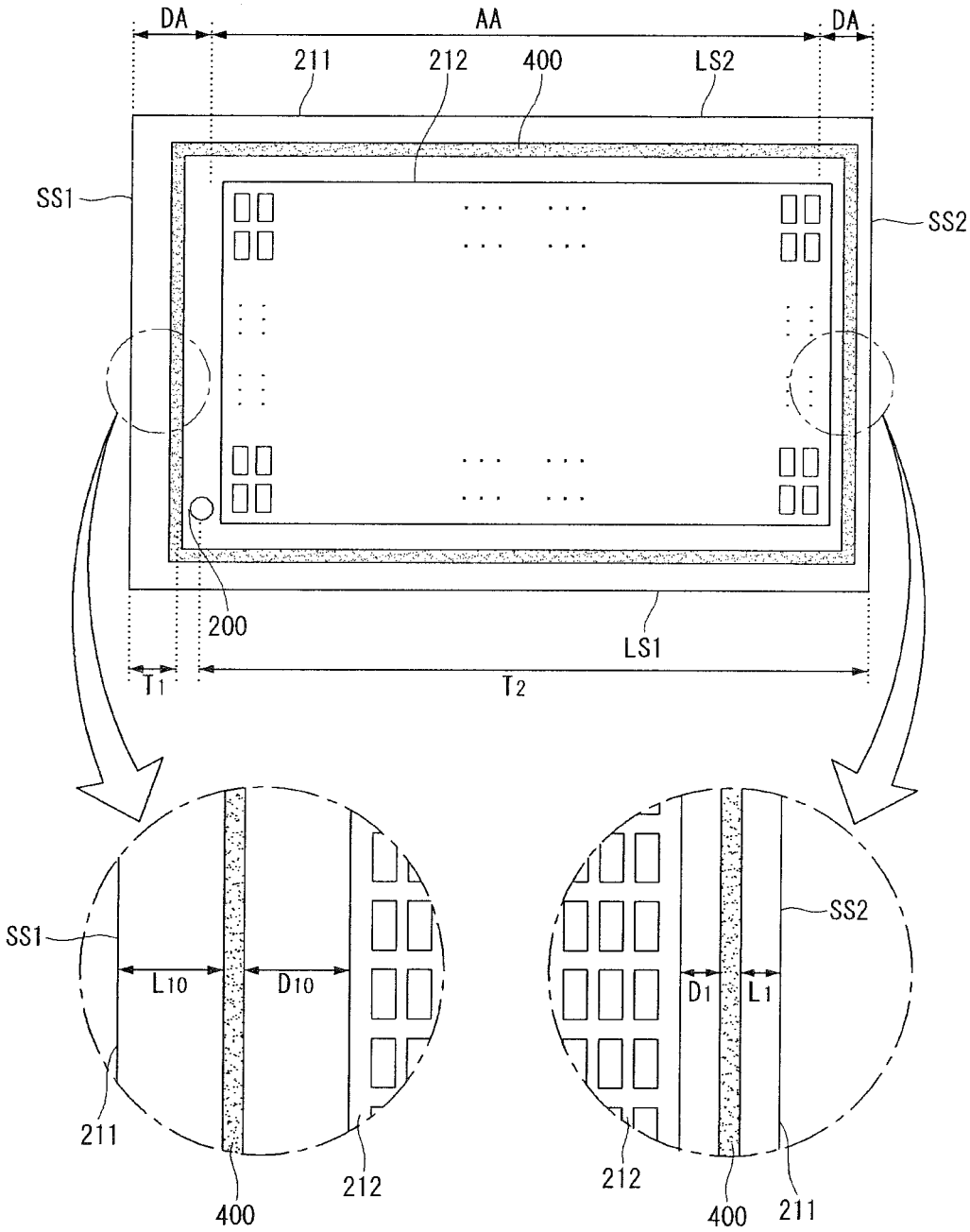

As shown in FIG. 6, a distance L10 between the seal portion 400 and the first short side SS1 on the first short side SS1 of the back substrate 211 may be greater than a distance L1 between the seal portion 400 and the second short side SS2 on the second short side SS2 of the back substrate 211. Namely, the seal portion 400 may be positioned closer to the second short side SS2 than the first short side SS1 of the back substrate 211.

Figure 7:
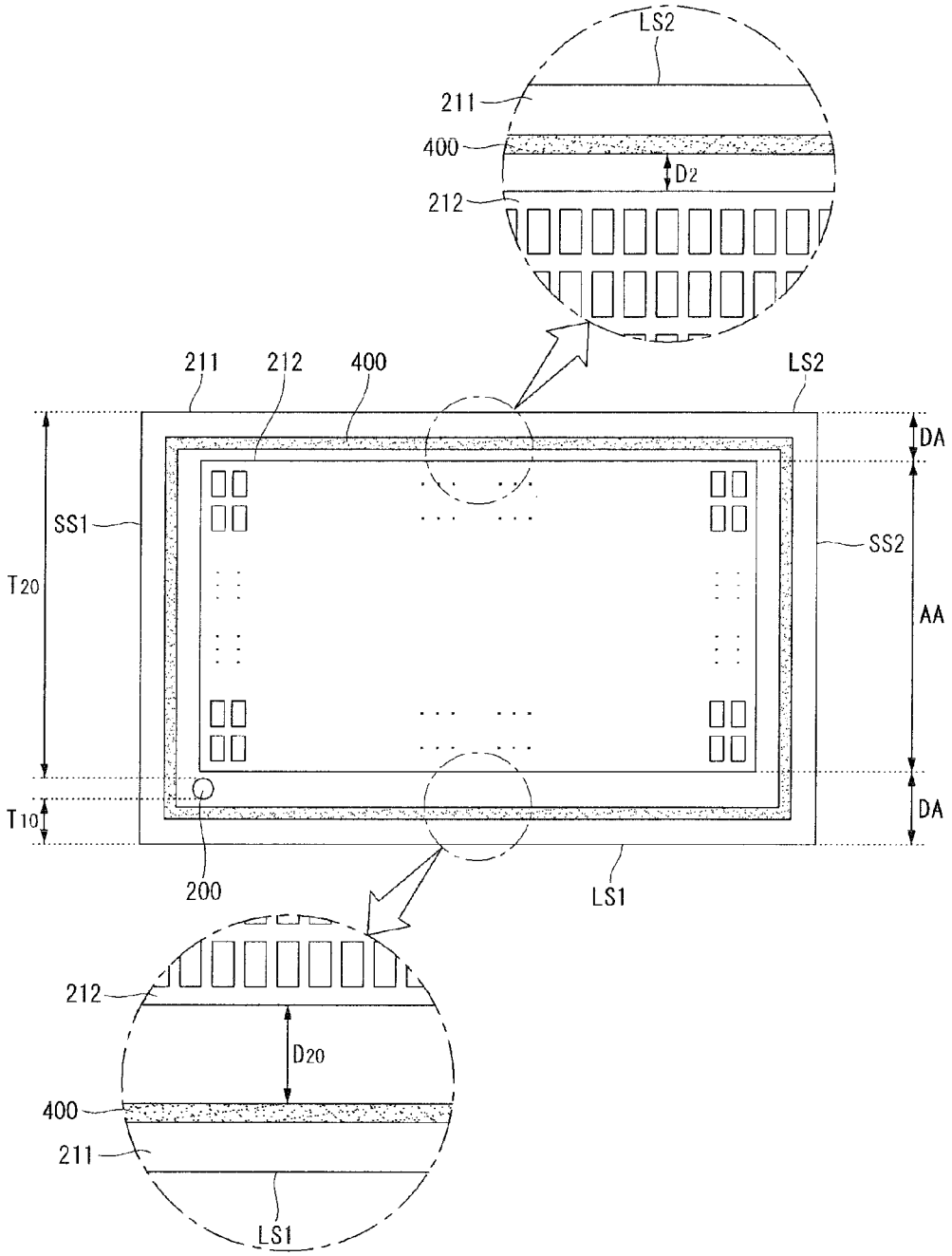

Alternatively, as shown in FIG. 7, a distance D20 between the barrier rib 212 and the seal portion 400 in a first region of the back substrate 211 may be greater than a distance D2 between the barrier rib 212 and the seal portion 400 in a second region of the back substrate 211 opposite the first region. More specifically, the distance D20 between the barrier rib 212 and the seal portion 400 on a first long side LS1 of the back substrate 211 may be greater than the distance D2 between the barrier rib 212 and the seal portion 400 on a second long side LS2 of the back substrate 211. In the embodiment of the invention, the first region of the back substrate 211 may correspond to the first long side LS1 of the back substrate 211 having the rectangular shape, and the second region of the back substrate 211 may correspond to the second long side LS2 of the rectangular back substrate 211.

The exhaust hole 200 may be formed in the first long side LS1 of the back substrate 211. Thus, a distance T10 between the exhaust hole 200 and the first long side LS1 may be less than a distance T20 between the exhaust hole 200 and the second long side LS2.

Further, it may be preferable that the exhaust hole 200 is formed between the seal portion 400 and the barrier rib 212 on the first long side LS1 of the back substrate 211. In other words, the exhaust hole 200 may be formed in the dummy area DA of the first long side LS1 of the back substrate 211.

As above, when the barrier rib 212 is positioned closer to the second long side LS2 than the first long side LS1 of the back substrate 211, the first long side LS1 of the back substrate 211 may provide a sufficient space. Hence, the exhaust hole 200 may be formed on the first long side LS1 of the back substrate 211. In this instance, because the sufficient space for the exhaust hole 200 may be provided on the first long side LS1 of the back substrate 211, the size of the exhaust hole 200 may increase. Hence, the exhaust characteristics may be improved without increasing the size of the plasma display panel. As a result, an excessive increase in the size of the bezel area of the plasma display panel may be prevented while improving the exhaust characteristics.

Figure 8:
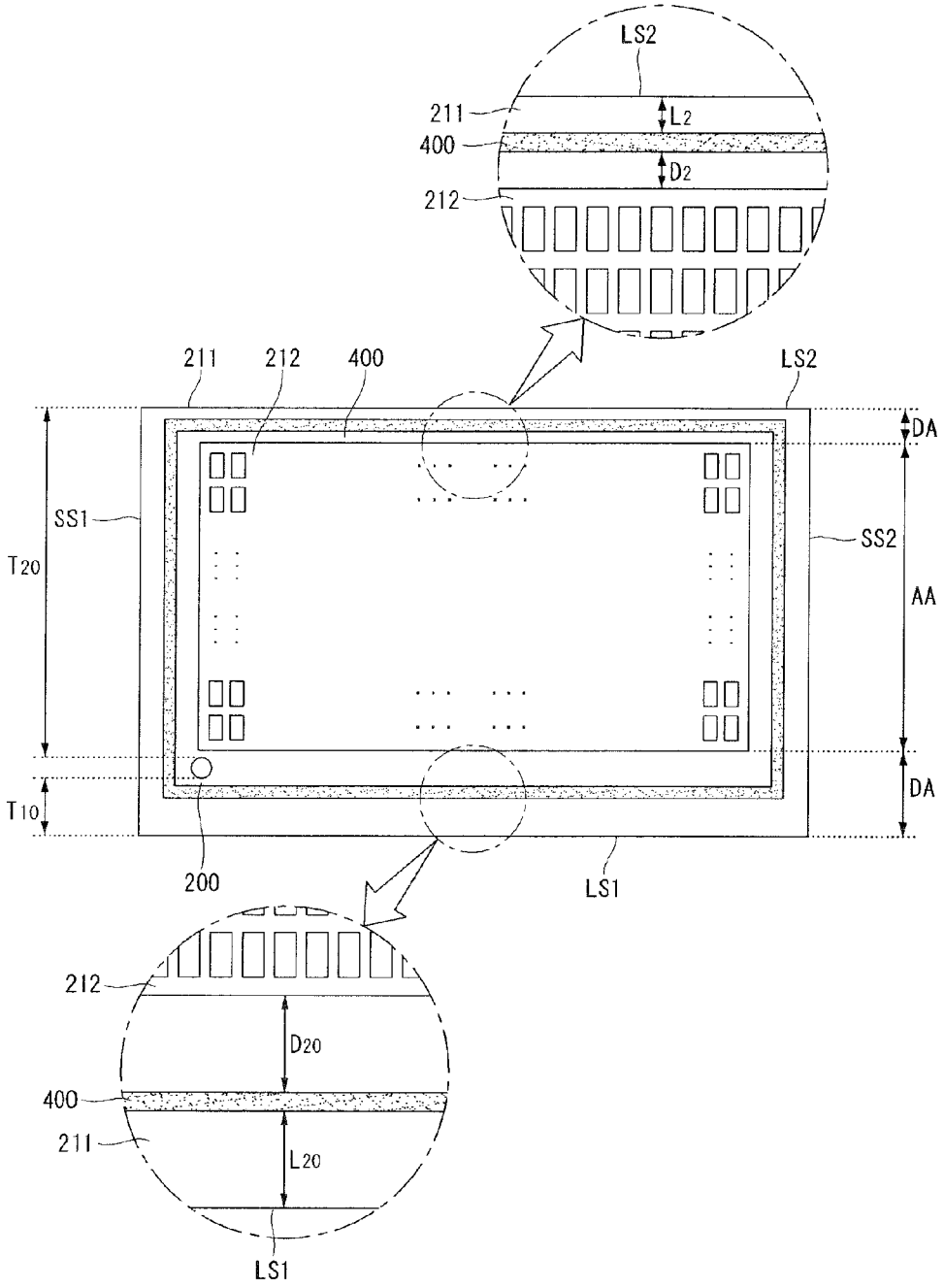

As shown in FIG. 8, a distance L20 between the seal portion 400 and the first long side LS1 on the first long side LS1 of the back substrate 211 may be greater than a distance L2 between the seal portion 400 and the second long side LS2 on the second long side LS2 of the back substrate 211. Namely, the seal portion 400 may be positioned closer to the second long side LS2 than the first long side LS1 of the back substrate 211.

Figure 9:
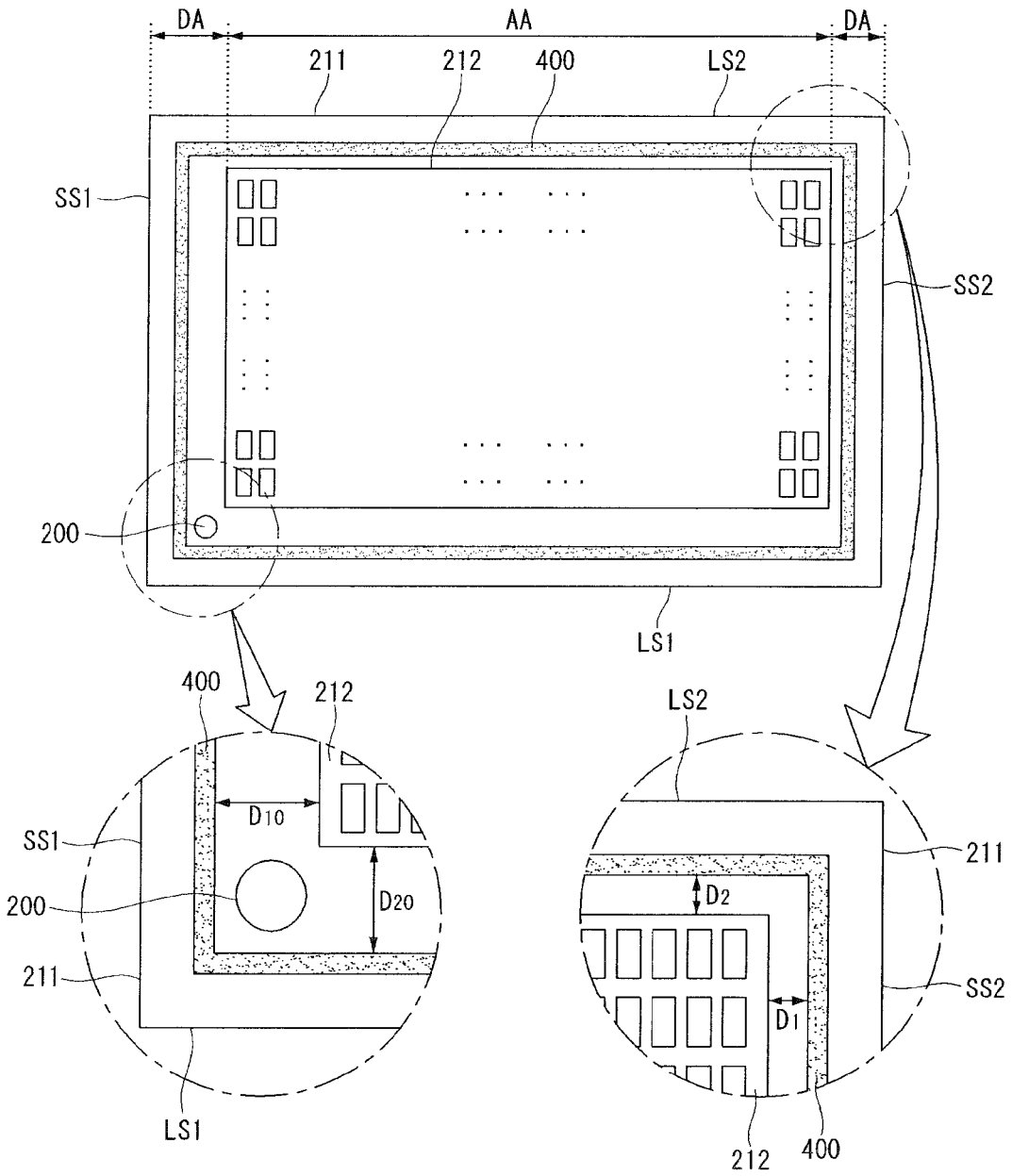

Alternatively, as shown in FIG. 9, the distance D20 between the barrier rib 212 and the seal portion 400 on the first long side LS1 of the back substrate 211 may be greater than the distance D2 between the barrier rib 212 and the seal portion 400 on the second long side LS2 of the back substrate 211. Further, the distance D10 between the barrier rib 212 and the seal portion 400 on the first short side SS1 of the back substrate 211 may be greater than the distance D1 between the barrier rib 212 and the seal portion 400 on the second short side SS2 of the back substrate 211.

In addition the exhaust hole 200 may be formed in a crossing portion between the first long side LS1 and the first short side SS1 of the back substrate 211. Hence, the exhaust characteristics may be improved without increasing the size of the plasma display panel. As a result, an excessive increase in the size of the bezel area of the plasma display panel may be prevented while improving the exhaust characteristics.

Figure 10:
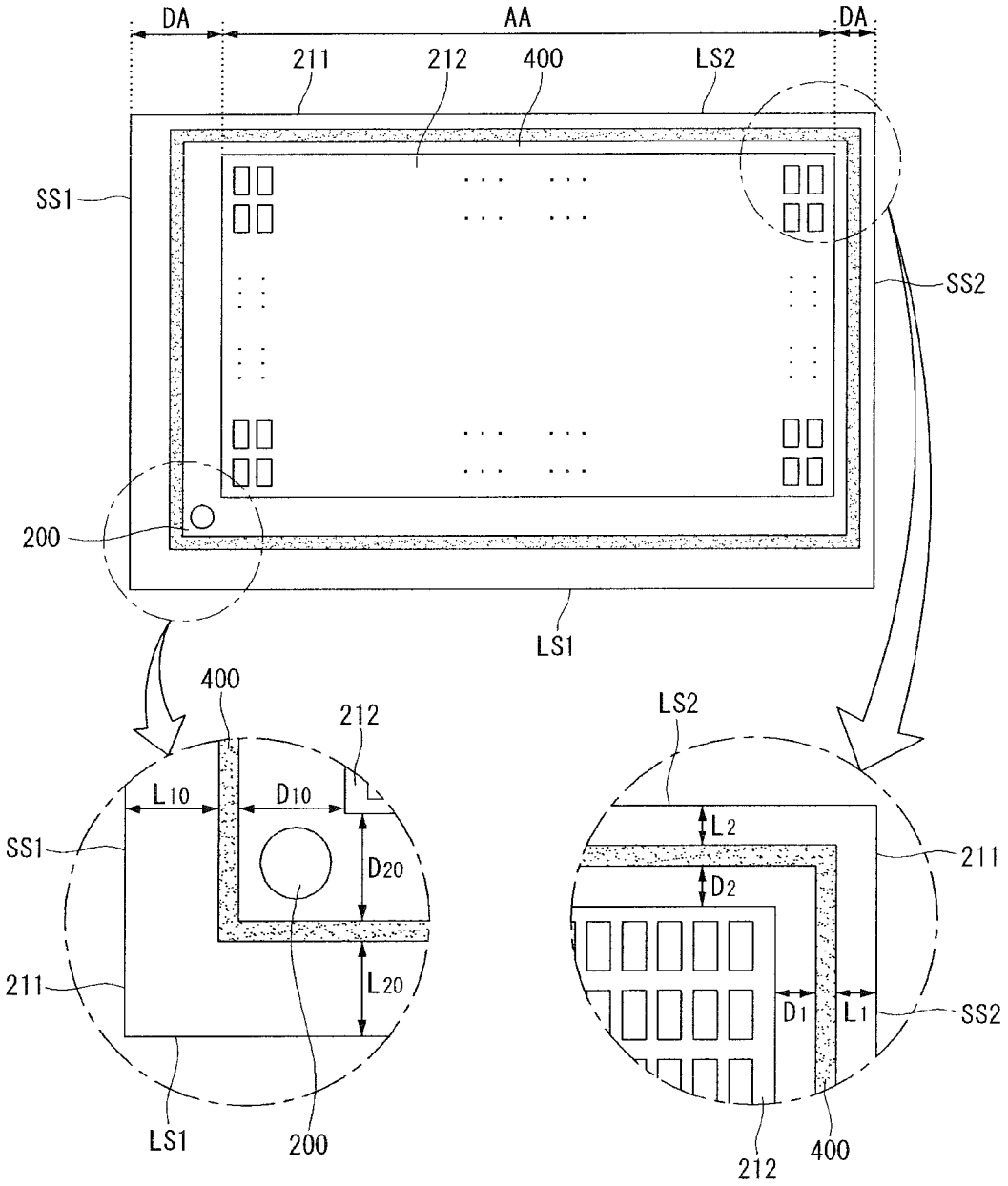

As shown in FIG. 10, the distance L20 between the seal portion 400 and the first long side LS1 on the first long side LS1 of the back substrate 211 may be greater than the distance L2 between the seal portion 400 and the second long side LS2 on the second long side LS2 of the back substrate 211. Further, the distance L10 between the seal portion 400 and the first short side SS1 on the first short side SS1 of the back substrate 211 may be greater than the distance L1 between the seal portion 400 and the second short side SS2 on the second short side SS2 of the back substrate 211. Namely, the seal portion 400 may be positioned close to the second long side LS2 and the second short side SS2 of the back substrate 211.

FIGS. 11 to 19 illustrate an exemplary configuration of a multi plasma display panel according to an exemplary embodiment of the invention. Structures and components identical or equivalent to those illustrated in FIGS. 1 to 10 are designated with the same reference numerals, and a further description may be briefly made or may be entirely omitted. For example, the multi plasma display panel according to the exemplary embodiment of the invention may use the plasma display panel illustrated in FIGS. 1 to 10.

Figure 11:
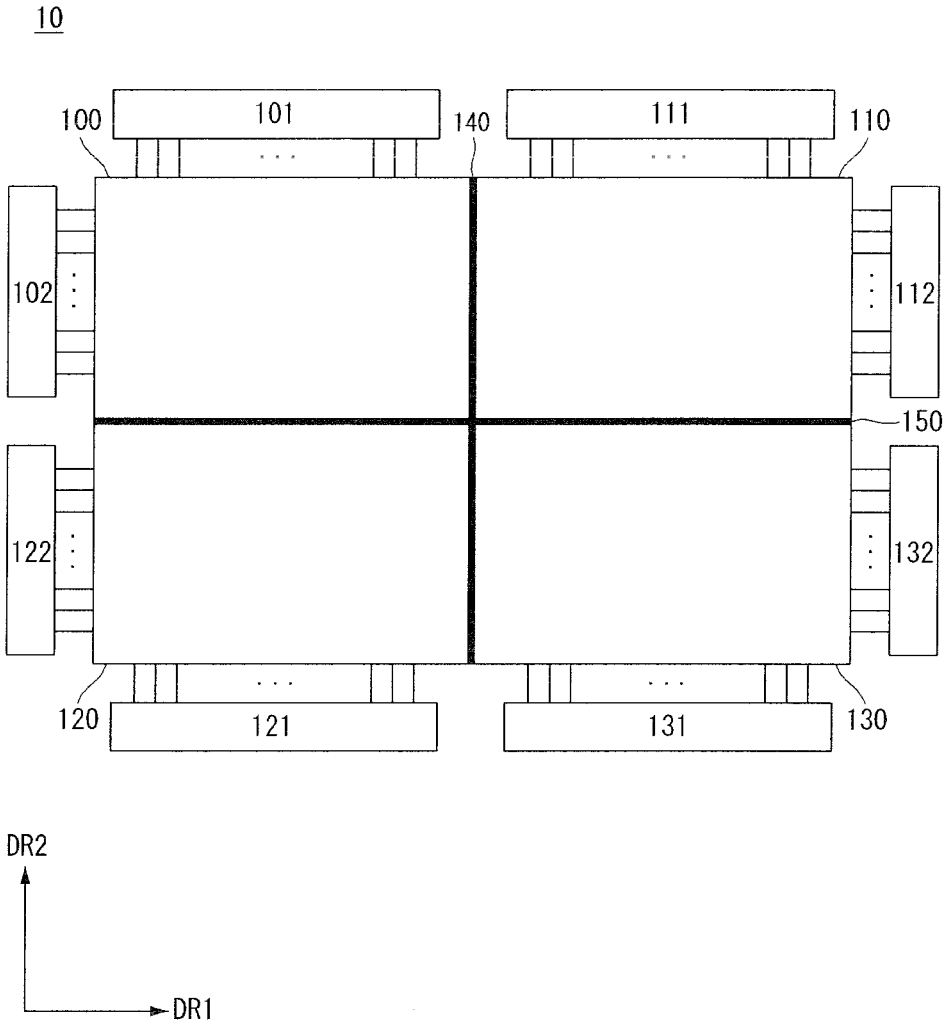
FIGS. 11 to 19 illustrate an exemplary configuration of a multi plasma display panel according to an exemplary embodiment of the invention.

As shown in FIG. 11, a multi plasma display panel 10 according to an exemplary embodiment of the invention may include a plurality of plasma display panels 100, 110, 120, and 130 that are positioned adjacent to one another.

A 1-1 driver 101 and a 1-2 driver 102 may supply driving signals to the first plasma display panel 100 of the plurality of plasma display panels 100, 110, 120, and 130. The 1-1 driver 101 and the 1-2 driver 102 may be integrated into one driver. Further, a 2-1 driver 111 and a 2-2 driver 112 may supply driving signals to the second plasma display panel 110. In other words, the multi plasma display panel 10 may be configured so that the plasma display panels 100, 110, 120, and 130 included in the multi plasma display panel 10 receive the driving signals from different drivers, respectively.

Further, seam areas 140 and 150 may be formed between the two adjacent plasma display panels. The seam areas 140 and 150 may indicate areas between the two adjacent plasma display panels. Because the multi plasma display panel 10 displays an image on the separate plasma display panels 100, 110, 120, and 130 positioned adjacent to one another, the seam areas 140 and 150 may be formed between the two adjacent plasma display panels.

A method for manufacturing the multi plasma display panel 10 is described below.

Figure 12:
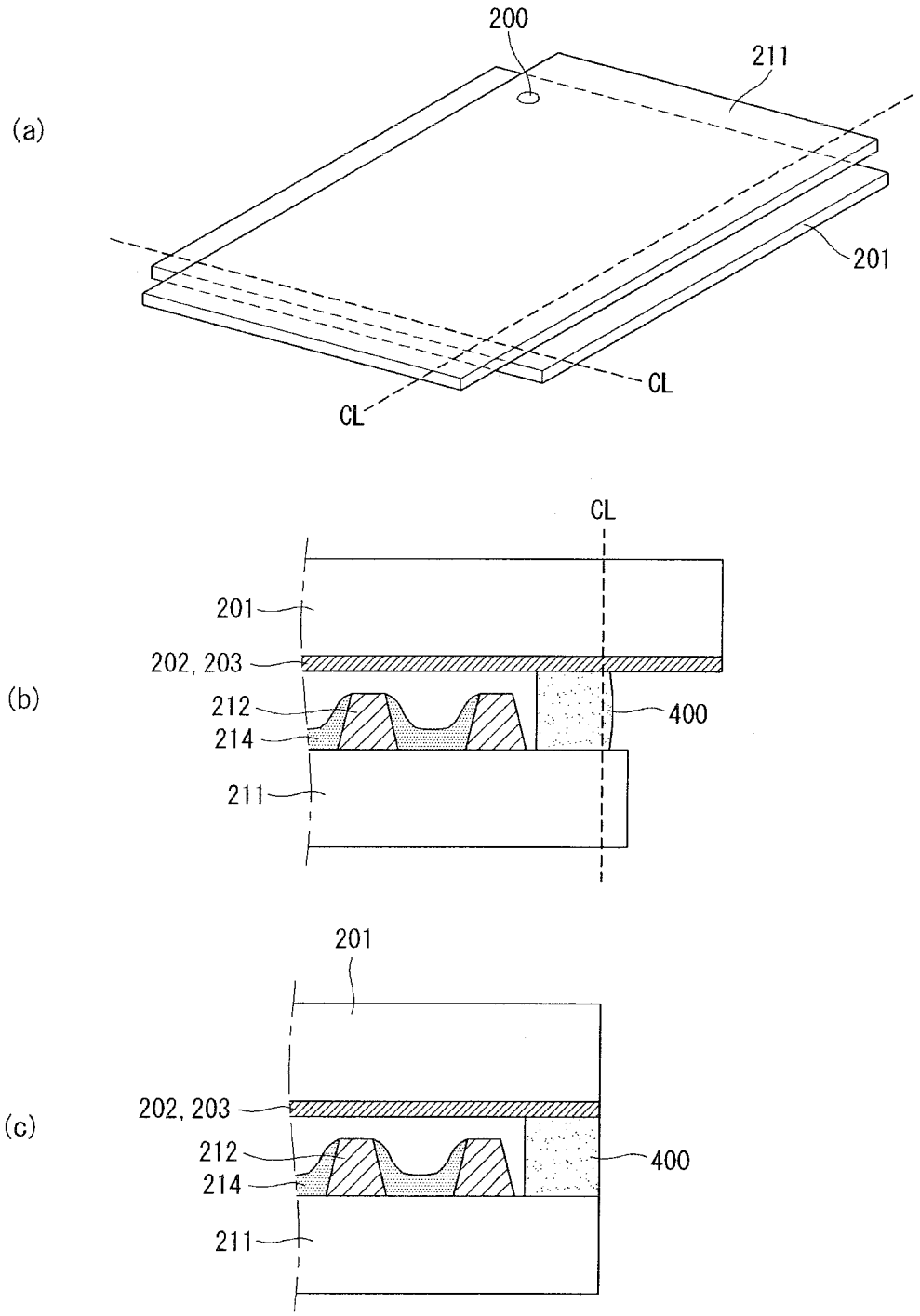

As shown in FIG. 12(*a*), a portion of each of the front substrate 201 and the back substrate 211, that are attached to each other, may be cut along a predetermined cutting line CL. A grinding process may be performed along with the cutting process. Namely, as shown in FIG. 12(*a*), one long side and one short side of each of the front substrate 201 and the back substrate 211 may be cut and ground. The cutting process may prevent at least one of the front substrate 201 and the back substrate 211 from excessively protruding. Hence, the size of a portion of the plasma display panel, on which the image is not displayed, may be reduced.

Further, as shown in FIGS. 12(*b*) and 12(*c*), the seal portion 400 may be cut in the cutting process of the front substrate 201 and the back substrate 211. As above, when the seal portion 400 is cut, the size of a portion of the plasma display panel, on which the image is not displayed may be reduced.

The plurality of plasma display panels manufactured using the method illustrated in FIGS. 12(*a*) to 12(*c*) may be disposed adjacent to one another to manufacture the multi plasma display panel.

Figure 13:
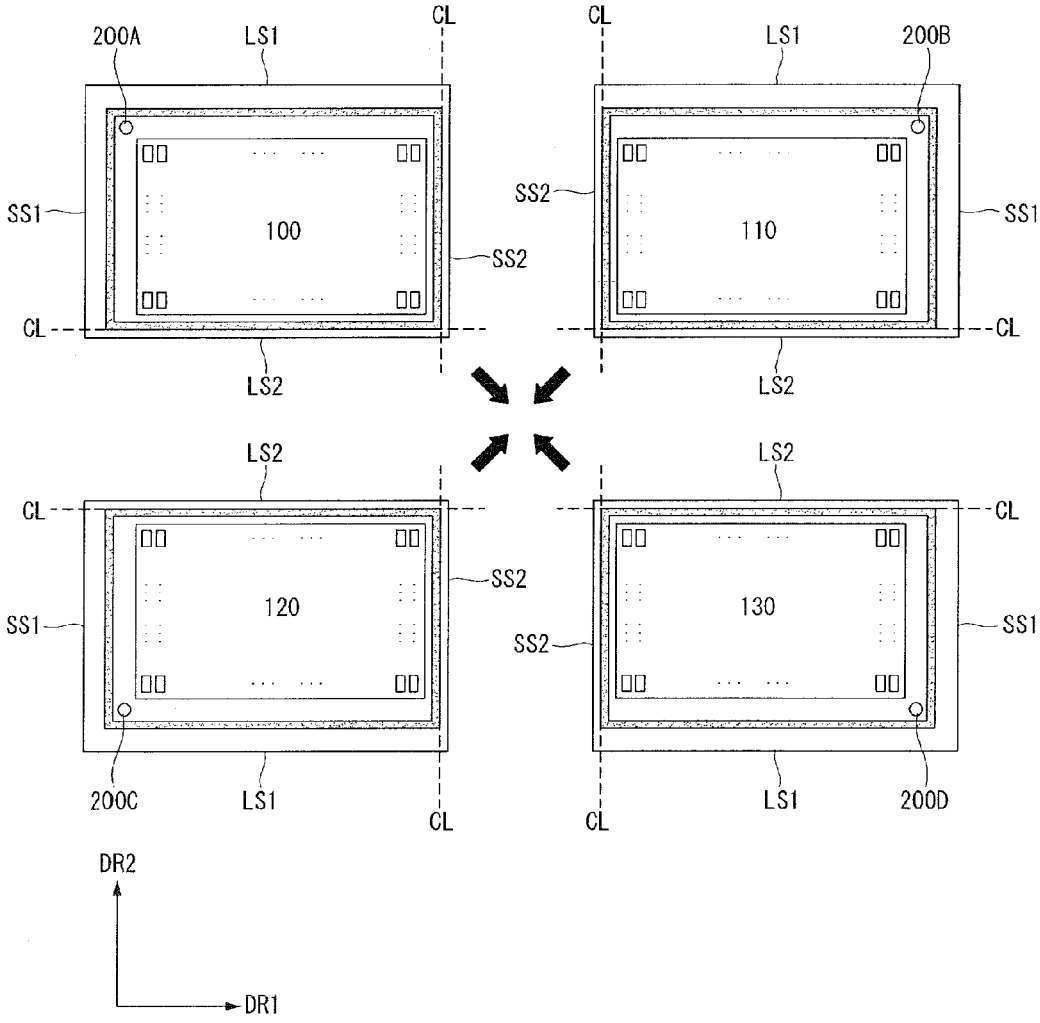

For example, as shown in FIG. 13, the first to fourth panels 100, 110, 120, and 130 may be arranged in a matrix structure of 2×2. The first to fourth panels 100, 110, 120, and 130 may be disposed, so that cutting surfaces of the first to fourth panels 100, 110, 120, and 130 are adjacent to one another.

More specifically, as shown in FIG. 13, the first panel 100 and the second panel 110 may be disposed adjacent to each other in a first direction DR1, and the first panel 100 and the third panel 120 may be positioned adjacent to each other in a second direction DR2 crossing the first direction DR1. Further, the second panel 110 and the fourth panel 130 may be disposed adjacent to each other in the second direction DR2, and the third panel 120 and the fourth panel 130 may be disposed adjacent to each other in the first direction DR1.

The cutting process and the grinding process may be performed on a second short side SS2 and a second long side LS2 of each of the first to fourth panels 100, 110, 120, and 130.

More specifically, the first and second panels 100 and 110 may be disposed so that the second short side SS2 of the first panel 100 is adjacent to the second short side SS2 of the second panel 110. The third and fourth panels 120 and 130 may be disposed so that the second short side SS2 of the third panel 120 is adjacent to the second short side SS2 of the fourth panel 130. The first and third panels 100 and 120 may be disposed so that the second long side LS2 of the first panel 100 is adjacent to the second long side LS2 of the third panel 120. The second and fourth panels 110 and 130 may be disposed so that the second long side LS2 of the second panel 110 is adjacent to the second long side LS2 of the fourth panel.

Unlike the embodiment of the invention, a viewer may view a discontinuous image displayed on a general multi plasma display panel because of a seam area of the general multi plasma display panel.

On the other hand, in the embodiment of the invention, as shown in FIG. 13, when the first to fourth panels 100, 110, 120, and 130 are disposed so that the cutting surfaces of the first to fourth panels 100, 110, 120, and 130 are adjacent to one another, the size of the seam areas 140 and 150 of the multi plasma display panel 10 may be reduced. Hence, the viewer may view a natural image displayed on the multi plasma display panel 10. Further, as shown in FIGS. 1 to 10, the distance between the barrier rib 212 and the seal portion 400 on one side of the back substrate 211 of each of the first to fourth panels 100, 110, 120, and 130 is different from the distance between the barrier rib 212 and the seal portion 400 on other side of the back substrate 211 of each of the first to fourth panels 100, 110, 120, and 130 opposite the one side, the size of the seam areas 140 and 150 of the multi plasma display panel 10 may be reduced.

Accordingly, the configuration and the characteristics of the plasma display panel illustrated in FIGS. 1 to 10 may be applied to the multi plasma display panel 10.

Figure 14:
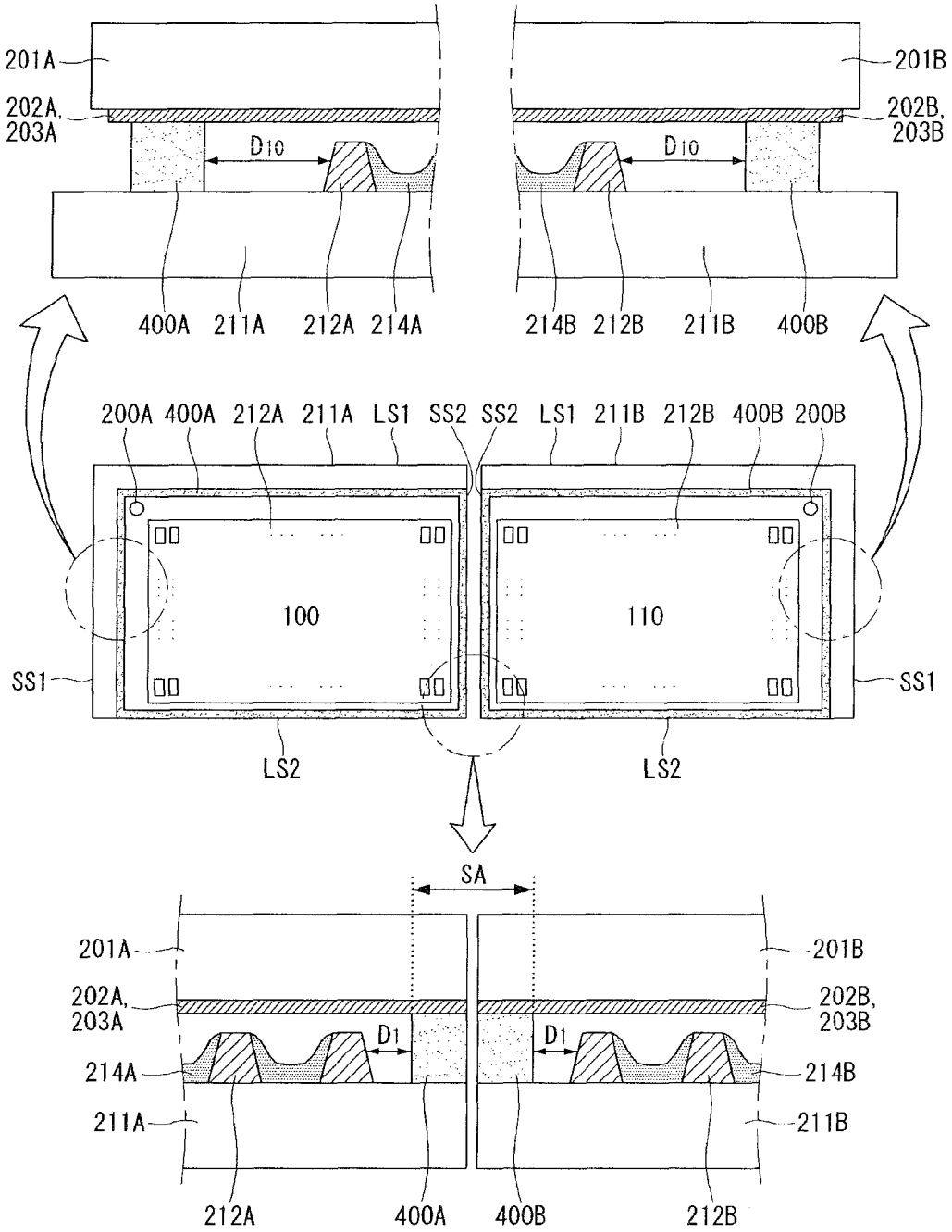

FIG. 14 illustrates a relationship between the first and second plasma display panels 100 and 110.

As shown in FIG. 14, a distance D10 between a barrier rib 212A and a seal portion 400A on a first short side SS1 of a back substrate 211A of the first panel 100 may be greater than a distance D1 between the barrier rib 212A and the seal portion 400A on a second short side SS2 of the back substrate 211A of the first panel 100. Further, a distance D10 between a barrier rib 212B and a seal portion 400B on a first short side SS1 of a back substrate 211B of the second panel 110 may be greater than a distance D1 between the barrier rib 212B and the seal portion 400B on a second short side SS2 of the back substrate 211B of the second panel 110.

The second short side SS2 of the first panel 100 and the second short side SS2 of the second panel 110 may be disposed adjacent to each other. In this instance, the size of a seam area between the first panel 100 and the second panel 110 may be reduced.

Further, when the cutting and grinding processes illustrated in FIG. 12 are performed on the second short sides SS2 of the first and second panels 100 and 110, the size of the seam area between the first panel 100 and the second panel 110 may be further reduced. As a result, the back substrates 211A and 211B formed outside the seal portions 400A and 400B on the second short sides SS2 of the first and second panels 100 and 110 may be cut.

An exhaust hole 200A may be formed in a crossing portion between a first long side LS1 and a first short side SS1 of the first panel 100, and an exhaust hole 200B may be formed in a crossing portion between a first long side LS1 and a first short side SS1 of the second panel 110. In this instance, the size of the exhaust holes 200A and 200B of the first and second panels 100 and 110 may increase. As a result, the size of the seam area between the first panel 100 and the second panel 110 may be reduced while improving the exhaust characteristics by increasing the size of the exhaust holes 200A and 200B of the first and second panels 100 and 110.

Although the embodiment of the invention illustrates the first to fourth panels 100, 110, 120, and 130 having the matrix structure of 2×2, other arrangement structures may be used. For example, the plurality of plasma display panels may be arranged in a matrix structure of 1×2 or 2×1.

Figure 15:
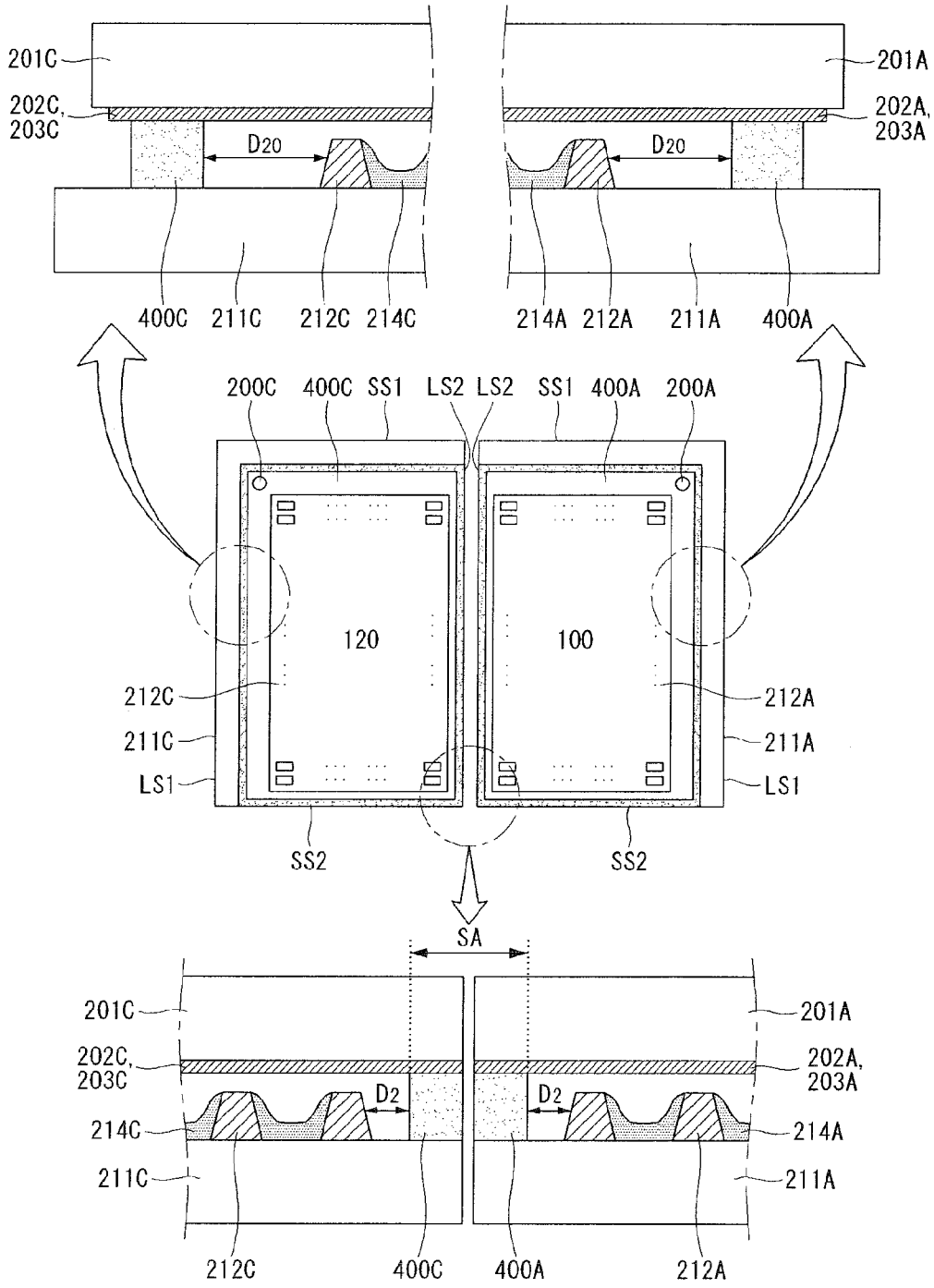

FIG. 15 illustrates a relationship between the first and third plasma display panels 100 and 120.

As shown in FIG. 15, a distance D20 between the barrier rib 212A and the seal portion 400A on the first long side LS1 of the back substrate 211A of the first panel 100 may be greater than a distance D2 between the barrier rib 212A and the seal portion 400A on a second long side LS2 of the back substrate 211A of the first panel 100. Further a distance D20 between a barrier rib 212C and a seal portion 400C on a first long side LS1 of a back substrate 211C of the third panel 120 may be greater than a distance D2 between the barrier rib 212C and the seal portion 400C on a second long side LS2 of the back substrate 211C of the third panel 120.

The second long side LS2 of the first panel 100 and the second long side LS2 of the third panel 120 may be disposed adjacent to each other. In this instance, the size of a seam area between the first panel 100 and the third panel 120 may be reduced.

Further, when the cutting and grinding processes illustrated in FIG. 12 are performed on the second long sides LS2 of the first and third panels 100 and 120, the size of the seam area between the first panel 100 and the third panel 120 may be further reduced. As a result, the back substrates 211A and 211C formed outside the seal portions 400A and 400C on the second long sides LS2 of the first and third panels 100 and 120 may be cut.

The exhaust hole 200A may be formed in the crossing portion between the first long side LS1 and the first short side SS1 of the first panel 100, and an exhaust hole 200C may be formed in a crossing portion between a first long side LS1 and a first short side SS1 of the third panel 120. In this instance, the size of the exhaust holes 200A and 200C of the first and third panels 100 and 120 may increase. As a result, the size of the seam area between the first panel 100 and the third panel 120 may be reduced while improving the exhaust characteristics by increasing the size of the exhaust holes 200A and 200C of the first and third panels 100 and 120.

Figure 16:
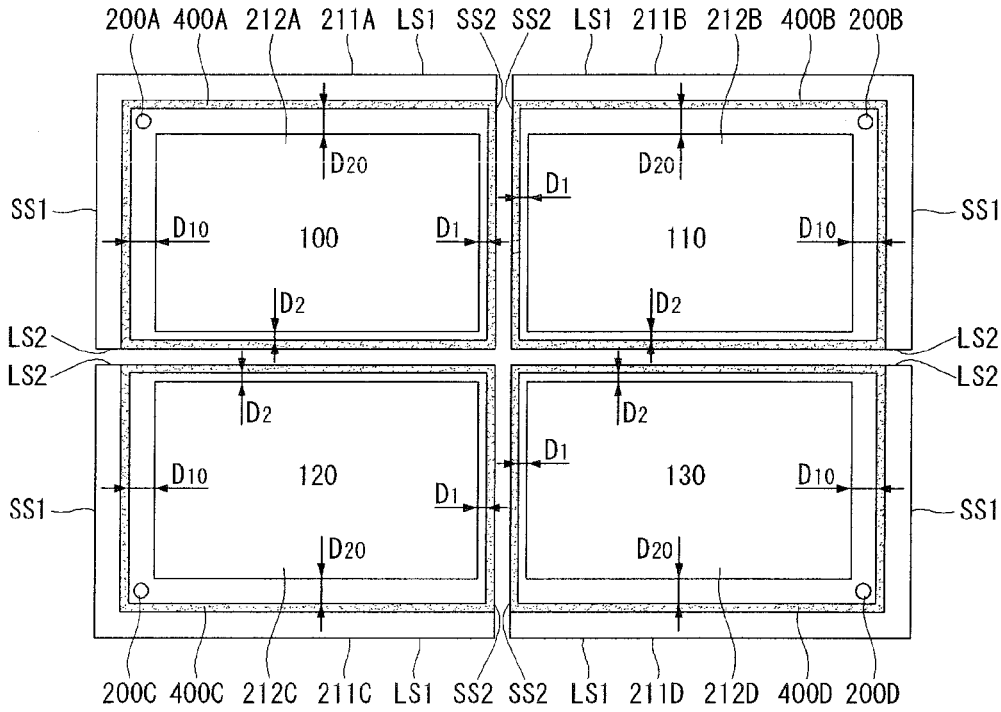

FIG. 16 illustrates the disposition structure between the first to fourth plasma display panels 100, 110, 120, and 130.

As shown in FIG. 16, the second short side SS2 of the first panel 100 and the second short side SS2 of the second panel 110 may be disposed adjacent to each other, and the second short side SS2 of the third panel 120 and the second short side SS2 of the fourth panel 130 may be disposed adjacent to each other. The distances D1 between the barriers ribs 212A-212D and the seal portions 400A-400D on the second short sides SS2 of the first to fourth panels 100, 110, 120, and 130 may be less than the distances D10 between the barriers ribs 212A-212D and the seal portions 400A-400D on the first short sides SS1 of the first to fourth panels 100, 110, 120, and 130.

Further, the second long side LS2 of the first panel 100 and the second long side LS2 of the third panel 120 may be disposed adjacent to each other, and the second long side LS2 of the second panel 110 and the second long side LS2 of the fourth panel 130 may be disposed adjacent to each other. The distances D2 between the barriers ribs 212A-212D and the seal portions 400A-400D on the second long sides LS2 of the first to fourth panels 100, 110, 120, and 130 may be less than the distances D20 between the barriers ribs 212A-212D and the seal portions 400A-400D on the first long sides LS1 of the first to fourth panels 100, 110, 120, and 130.

The exhaust holes 200A-200D may be formed in crossing portions between the first long sides LS1 and the first short sides SS1 of the back substrates 211A-211D of the first to fourth panels 100, 110, 120, and 130. Namely, the exhaust holes 200A-200D may be formed at each edge of the multi plasma display panel 10.

Figure 17:
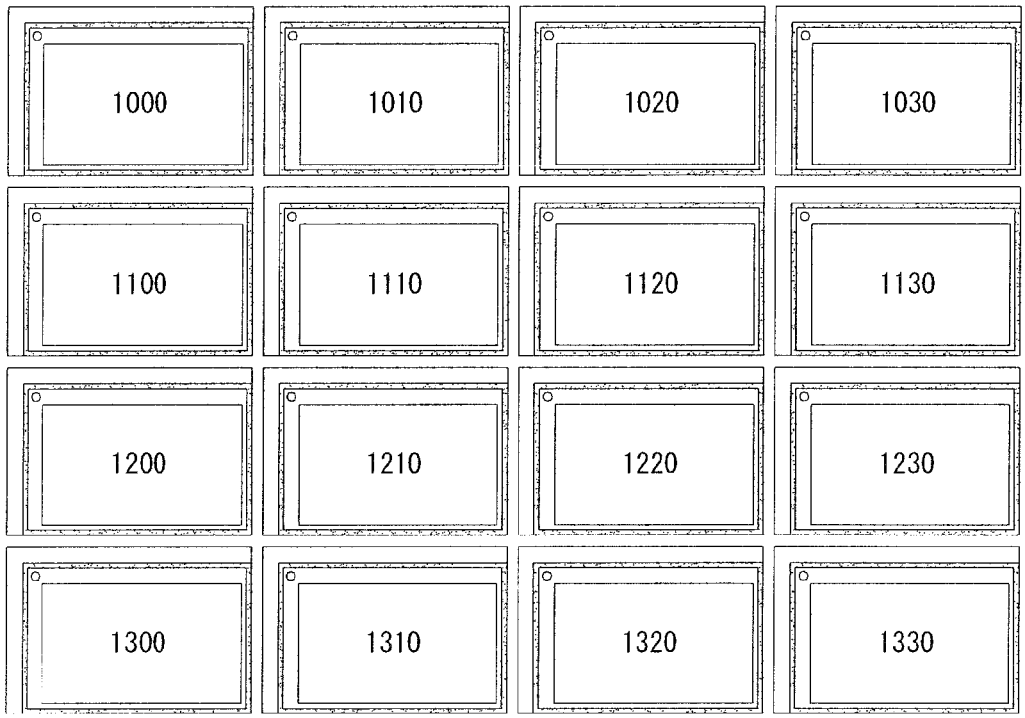

The plurality of plasma display panels may be arranged in matrix structures other than the matrix structure of 2×2. For example, as shown in FIG. 17, the plurality of plasma display panels may be arranged in a matrix structure of 4×4. When the multi plasma display panel is manufactured using a large number of plasma display panels, the large number of plasma display panels may be disposed in the same pattern.

In plasma display panels 1000-1330 having the matrix structure of 4×4 shown in FIG. 17, for example, the first panel 1000, the second panel 1010, the fifth panel 1100, and the sixth panel 1110 are described with reference to FIG. 18.

Figure 18:
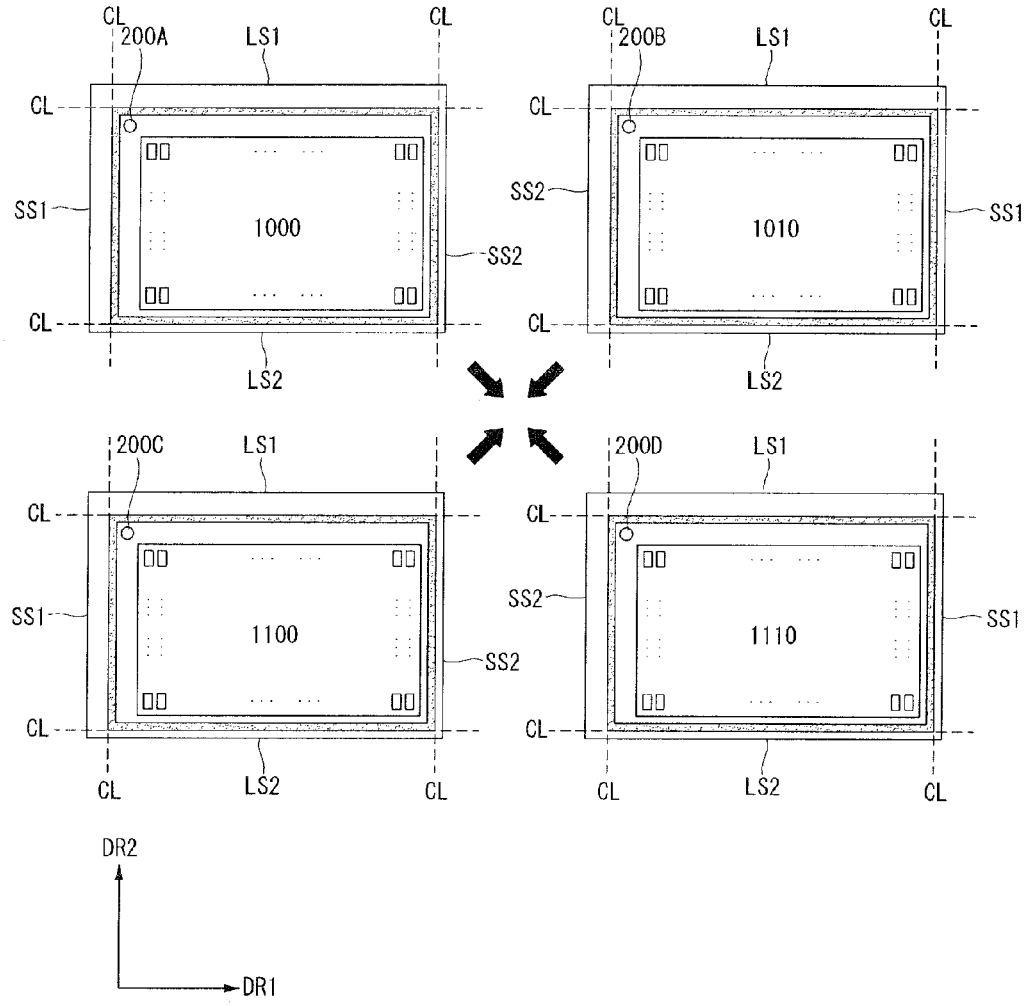

As shown in FIG. 18, the first panel 1000 and the second panel 1010 may be disposed adjacent to each other in a first direction DR1, the first panel 1000 and the fifth panel 1100 may be disposed adjacent to each other in a second direction DR2 crossing the first direction DR1, the sixth panel 1110 and the second panel 1010 may be disposed adjacent to each other in the second direction DR2, and the sixth panel 1110 and the fifth panel 1100 may be disposed adjacent to each other in the first direction DR1.

The cutting process and the grinding process illustrated in FIG. 12 may be performed on a second short side SS2 and a second long side LS2 of each of the first panel 1000, the second panel 1010, the fifth panel 1100, and the sixth panel 1110.

The first and second panels 1000 and 1010 may be disposed so that the second short side SS2 of the first panel 1000 and the first short side SS1 of the second panel 1010 are adjacent to each other. The fifth and sixth panels 1100 and 1110 may be disposed so that the second short side SS2 of the fifth panel 1100 and the first short side SS1 of the sixth panel 1110 are adjacent to each other. The first and fifth panels 1000 and 1100 may be disposed so that the second long side LS2 of the first panel 1000 and the first long side LS1 of the fifth panel 1100 are adjacent to each other. The second and sixth panels 1010 and 1110 may be disposed so that the second long side LS2 of the second panel 1010 and the first long side LS1 of the sixth panel 1110 are adjacent to each other.

In the structure illustrated in FIG. 18, because the sufficient spaces for the exhaust holes 200A-200D may be secured, the exhaust characteristic may be improved. Further, the plurality of plasma display panels may be disposed in the same pattern, the number of unit plasma display panels included in the multi plasma display panel may increase. For example, various matrix structures of 3×3, 3×4, 4×3, 4×4, 5×5, and 6×6 may be used.

Figure 19:
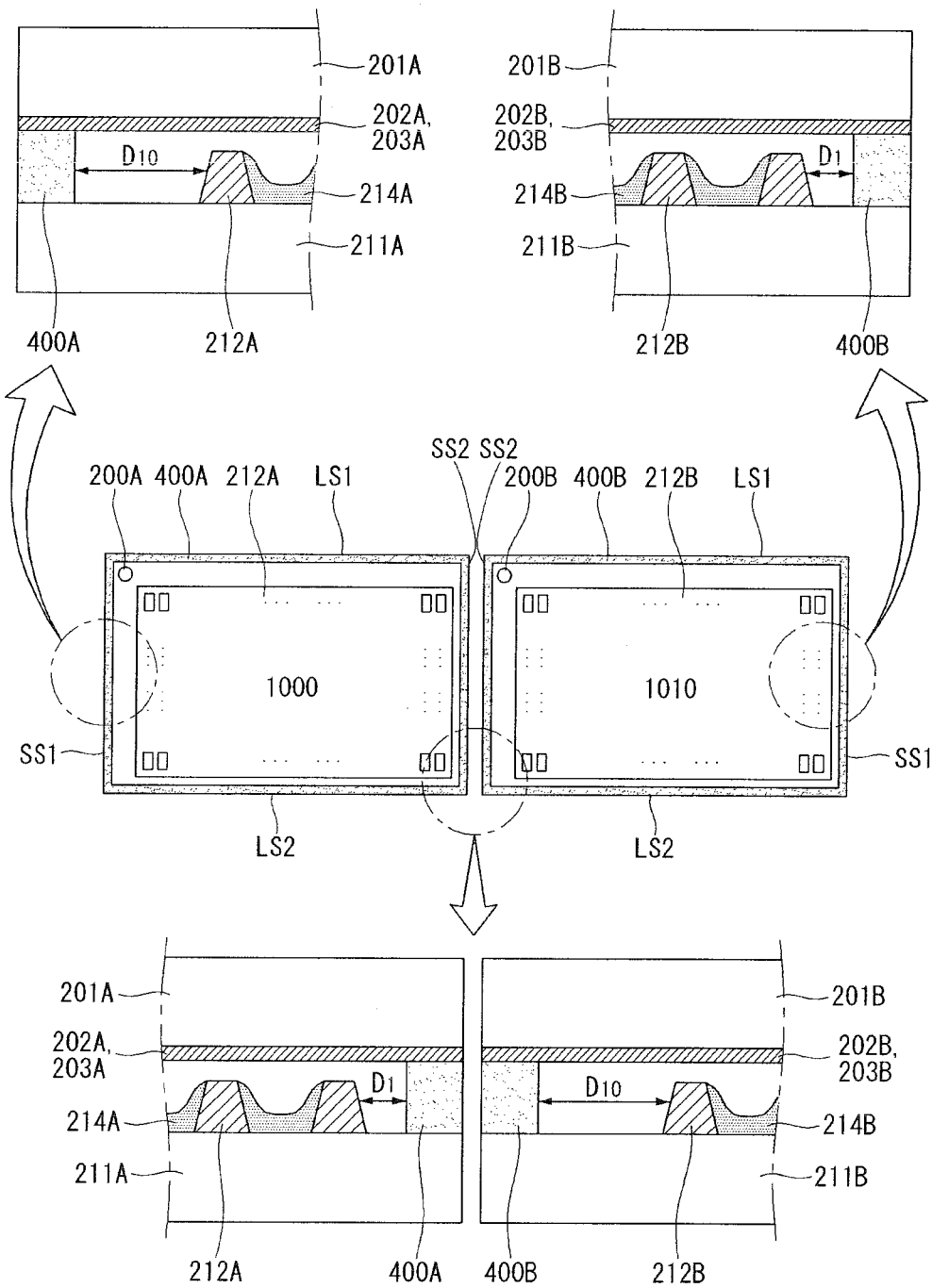

In the structure illustrated in FIG. 18, a relationship between the first panel 1000 and the second panel 1010 is illustrated in FIG. 19.

As shown in FIG. 19, a distance D10 between a barrier rib 212A and a seal portion 400A on a first short side SS1 of a back substrate 211A of the first panel 1000 may be greater than a distance D1 between the barrier rib 212A and the seal portion 400A on a second short side SS2 of the back substrate 211A of the first panel 1000. Further, a distance D10 between a barrier rib 212B and a seal portion 400B on a first short side SS1 of a back substrate 211B of the second panel 1010 may be greater than a distance D1 between the barrier rib 212B and the seal portion 400B on a second short side SS2 of the back substrate 211B of the second panel 1010.

The second short side SS2 of the first panel 1000 and the second short side SS2 of the second panel 1010 may be disposed adjacent to each other. Hence, the distance D1 between the barrier rib 212A and the seal portion 400A of the first panel 1000 may be different from the distance D10 between the barrier rib 212B and the seal portion 400B of the second panel 1010 in a boundary portion between the first panel 1000 and the second panel 1010.

Further, an exhaust hole of one of the two adjacent panels included in the multi plasma display panel may be formed in a boundary portion between the two adjacent panels.

Although embodiments have been described with reference to a number of illustrative embodiments thereof, it should be understood that numerous other modifications and embodiments can be devised by those skilled in the art that will fall within the scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A plasma display panel comprising:

a front substrate;

a back substrate positioned opposite the front substrate, the back substrate includes an exhaust hole;

a barrier rib positioned between the front substrate and the back substrate to partition a discharge cell; and a seal portion positioned outside the barrier rib in an area between the front substrate and the back substrate, wherein the exhaust hole is formed in an area between the barrier rib and the seal portion, wherein the barrier rib includes a first barrier rib that is parallel to both a first long side and a second long side of the front substrate and the back substrate and a second barrier rib that are parallel to both a first short side and a second short side of the front substrate and the back substrate, wherein the first long side is opposite to the second long side, the first short side is opposite to the second short side, the first long side is adjacent to the first short side and the second short side, and the second long side is adjacent to the first short side and the second short side, wherein a distance between the first barrier rib and the seal portion in a first region corresponding to the first long side of each of the front substrate and the back substrate is greater than a distance between the first barrier rib and the seal portion in a second region corresponding to the second long side of each of the front substrate and the back substrate opposite the first region, wherein a distance between the second barrier rib and the seal portion in a third region corresponding to the first short side of each of the front substrate and the back substrate adjacent to the first and second regions is greater than a distance between the second barrier rib and the seal portion in a fourth region corresponding to the second short side of each of the front substrate and the back substrate opposite the third region, and wherein the exhaust hole is positioned in a corner portion adjacent to the first region and the third region of the back substrate.

2. The plasma display panel of claim 1, wherein a distance between an edge of the back substrate and the seal portion in the first region is greater than a distance between the an edge of the back substrate and the seal portion in the second region, wherein a distance between and edge of the back substrate and the seal portion in the third region is greater than a distance between an edge of the back substrate and the seal portion in the fourth region.

3. A multi plasma display panel comprising:

a first plasma display panel;

a second plasma display panel disposed adjacent to the first plasma display panel in a first direction;

a third plasma display panel disposed adjacent to the first plasma display panel in a second direction crossing the first direction; and a fourth plasma display panel that is disposed adjacent to the third plasma display panel in the first direction and is disposed adjacent to the second plasma display panel in the second direction, wherein each of the first, second, third, and fourth plasma display panels includes:

a front substrate;

a back substrate positioned opposite the front substrate the back substrate includes an exhaust hole;

a barrier rib positioned between the front substrate and the back substrate to partition a discharge cell; and a seal portion positioned outside the barrier rib in an area between the front substrate and the back substrate, wherein the exhaust hole is formed in an area between the barrier rib and the seal portion, wherein the barrier rib includes a first barrier rib that is parallel to both a first long side and a second long side of the front substrate and the back substrate and a second barrier rib that are parallel to both a first short side and a second short side of the front substrate and the back substrate, wherein the first long side is opposite to the second long side, the first short side is opposite to the second short side, the first long side is adjacent to the first short side and the second short side, and the second long side is adjacent to the first short side and the second short side, wherein a distance between the first barrier rib and the seal portion in a first region corresponding to the first long side of each of the front substrate and the back substrate of each of the first to fourth plasma display panels is greater than a distance between the first barrier rib and the seal portion in a second region corresponding to the second long side of each of the front substrate and the back substrate of each of the first to fourth plasma display panels opposite the first region, wherein a distance between the second barrier rib and the seal portion in a third region corresponding to the first short side of each of the front substrate and the back substrate of each of the first to fourth plasma display panels adjacent to the first and second regions is greater than a distance between the second barrier rib and the seal portion in a fourth region corresponding to the second short side of each of the front substrate and the back substrate of each of the first to fourth plasma display panels opposite the third region, and wherein the exhaust hole is formed in a corner portion adjacent to the first region and the third region of the back substrate.

4. The multi plasma display panel of claim 3, wherein, in each of the first to fourth plasma display panels, a width of the seal portions in the first region and the third region is greater than a width of the seal portions in the second region and the fourth region.

5. The multi plasma display panel of claim 3, wherein the fourth region of the first panel is adjacent to the fourth region of the second panel, the second region of the first panel is adjacent to the second region of the third panel, the fourth region of the fourth panel is adjacent to the fourth region of the third panel, and the second region of the fourth panel is adjacent to the second region of the second panel, or wherein the fourth region of the first panel is adjacent to the third region of the second panel, the first region of the first panel is adjacent to the second region of the third panel, the third region of the fourth panel is adjacent to the fourth region of the third panel, and the first region of the fourth panel is adjacent to the second region of the second panel.

6. A plasma display panel comprising:

a front substrate and a back substrate disposed opposite the front substrate, the front and back substrates including a pair of oppositely disposed long sides and a pair of oppositely disposed short sides, the back substrate including an exhaust hole;

barrier ribs positioned between the front and back substrates to partition a discharge cell, a distance between an outermost first barrier rib and the seal in a first region corresponding to one of the long sides of the substrates is greater than a distance between the an outermost first barrier rib and the seal in a second region corresponding to the other long side of the substrates opposite the first region, a distance between an outermost second barrier rib and the seal in a third region corresponding to one of the first short sides of the substrates adjacent to the first and second regions is greater than a distance between an outermost second barrier rib and the seal in a fourth region corresponding to the othershort side of the substrates opposite the third region; and the exhaust hole is positioned in a corner portion adjacent to the first region and the third region of the back substrate.

7. The plasma display panel according to claim 6, wherein a distance between an edge of the back substrate and the seal in the first region is greater than a distance between the an edge of the back substrate and the seal in the second region, and a distance between and edge of the back substrate and the seal in the third region is greater than a distance between an edge of the back substrate and the seal in the fourth region.

8. A multi plasma display panel plasma comprising a plurality of plasma display panels according to claim 6, comprising:

a first plasma display panel;

a second plasma display panel disposed adjacent to the first plasma display panel in a first direction;

a third plasma display panel disposed adjacent to the first plasma display panel in a second direction crossing the first direction; and a fourth plasma display panel that is disposed adjacent to the third plasma display panel in the first direction and is disposed adjacent to the second plasma display panel in the second direction.

* * * * *